US006968951B2

(12) United States Patent
Magnusson

(10) Patent No.: US 6,968,951 B2
(45) Date of Patent: Nov. 29, 2005

(54) PACKAGING

(75) Inventor: Birgir Magnusson, Copenhagen (DK)

(73) Assignee: Nokia Corporation, Espoo (FI)

( * ) Notice: Subject to any disclaimer, the term of this patent is extended or adjusted under 35 U.S.C. 154(b) by 149 days.

(21) Appl. No.: 10/085,006

(22) Filed: Mar. 1, 2002

(65) Prior Publication Data

US 2003/0164320 A1 Sep. 4, 2003

(51) Int. Cl.[7] ..... B65D 73/00; B65D 5/50
(52) U.S. Cl. ..... 206/470; 206/461; 206/759
(58) Field of Search ..... 206/470, 461, 206/467, 219–222, 471, 469, 462, 759, 703–705, 206/576, 38

(56) References Cited

U.S. PATENT DOCUMENTS 3,358,824 A * 12/1967 Stagnitto ..... 206/459.5
4,383,607 A * 5/1983 Lordahl et al. ..... 206/459.5
D281,580 S * 12/1985 Stevens ..... D9/415
4,666,037 A * 5/1987 Weissman ..... 206/63.5
4,739,883 A * 4/1988 Mohs et al. ..... 206/470
4,795,029 A * 1/1989 Campbell et al. ..... 206/278
5,090,568 A 2/1992 Tse
5,147,035 A * 9/1992 Hartman ..... 206/45.23
5,251,760 A 10/1993 Smith et al.
5,277,920 A * 1/1994 Weaver, Jr. ..... 206/469
5,456,382 A * 10/1995 Gringer ..... 206/355
5,462,167 A * 10/1995 Polinski et al. ..... 206/455
5,593,036 A * 1/1997 Dyble et al. ..... 206/464
5,878,886 A * 3/1999 Marshall ..... 206/470
5,982,881 A 11/1999 Mischenko
5,988,381 A * 11/1999 Ling ..... 206/349
6,065,589 A * 5/2000 Ouwens ..... 206/6.1
6,330,945 B1 * 12/2001 Reimer ..... 206/470
6,439,390 B1 * 8/2002 Kumakura et al. ..... 206/705

FOREIGN PATENT DOCUMENTS

JP 2002166971 6/2002

* cited by examiner

*Primary Examiner*—Mickey Yu
*Assistant Examiner*—J. Gregory Pickett
(74) *Attorney, Agent, or Firm*—Antonelli, Terry, Stout and Kraus, LLP.

(57) ABSTRACT

The invention relates to a packaging for a communication terminal cover provided with a keymat. The packaging is provided with a foldable part that holds the keymat in a relative position to the terminal cover.

6 Claims, 4 Drawing Sheets

PACKAGING

BACKGROUND OF THE INVENTION

1. Field of the Invention

The present invention relates to a packaging an article, and in particular a packaging for accommodate a cover to a communication terminal and a keymat such a cover.

2. Description of Prior Art

Packaging for communication terminal covers have previously consisted of two separate plastic parts, wherein between the cover has been held. From cost and production view is it not very efficient to have several parts in the packaging. In the two prior art document U.S. Pat. No. 6,050,415 and U.S. Pat. No. 6,105,784 has this been considered and the two parts have been become one part solving the same problem. Both document U.S. Pat. No. 6,050,415 and U.S. Pat. No. 6,105,784 shows a packaging for an article that include a back cardboard sheet and a front cardboard sheet, which are sandwiched together. The U.S. Pat. No. 6,105,784 further describes that the packaging includes an insert that is accommodated to and holds the packed article.

SUMMARY OF THE INVENTION

It is an object of the present invention is to provide a packaging that holds an exchangeable cover to a communication terminal so that the keymat always is easily visible in the cover.

According to a first preferred embodiment of the claimed invention this objective is obtained by a packaging provided with a flexible part that applies a force on the keymat to keep the keymat in the same position.

Another object of the invention is to provide a packaging that with a simple construction that holds an exchangeable cover and keymat to a communication terminal in relation to each other.

According to the preferred embodiment of the claimed invention this objective is obtained by a packaging provided with a protruding part, wherein the exchangeable cover and keymat is disposed, and a foldable part that applies a force on the keypad to hold the keymat in relation to the cover.

Yet another object of the invention is to provide a method for holding an exchangeable cover and a keymat in relation to each other in a packaging.

According to an preferred embodiment of the claimed invention this objective is obtained by a method of enabling a pressure to be applied on a keymat while being disposed in a packaging, to enabling the keymat to be in fixed relation to an exchangeable cover.

BRIEF DESCRIPTION OF THE DRAWING

The invention will be explained more fully below, by way of example, in connection with preferred embodiments and with reference to the drawing, in which.

DETAILED DESCRIPTION OF THE INVENTION

Figure 1:
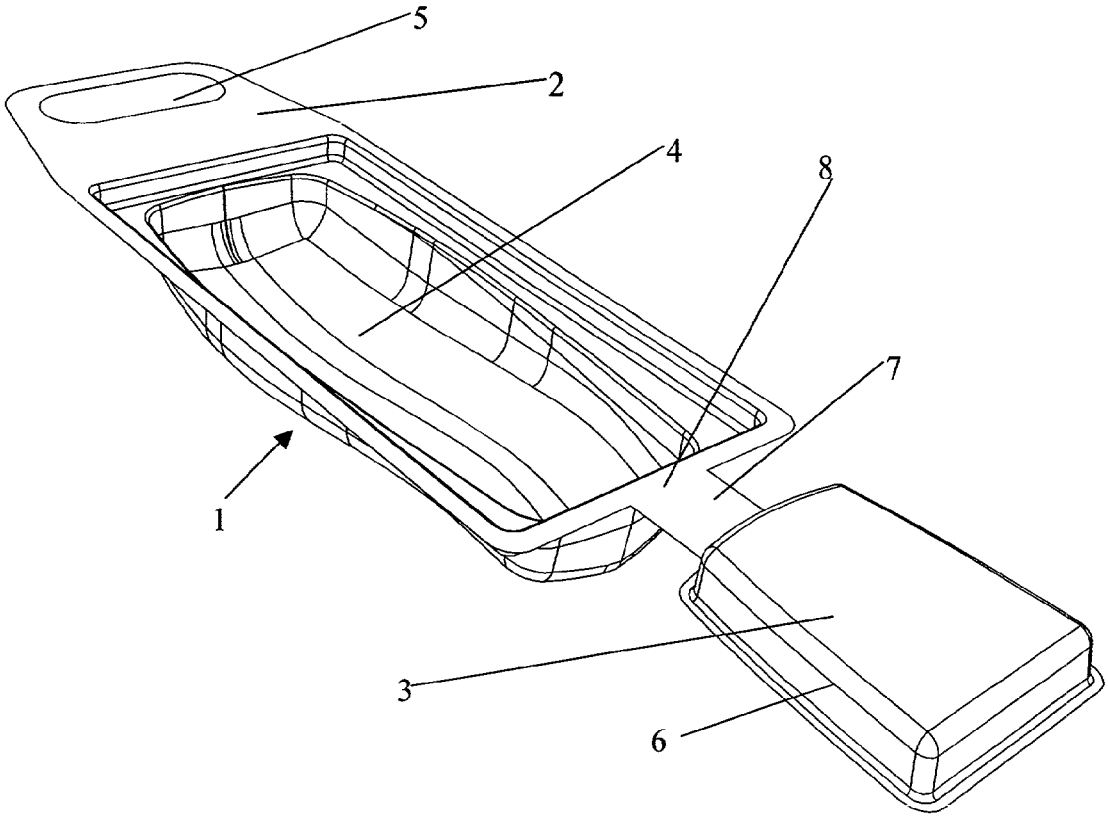
FIG. 1 shows in a perspective view the packaging.

A packaging 1 of plastic member is shown in FIG. 1 comprising a first part 2 and a second part 3, which are connected to each other. The second part 3 is movable or foldable in relation to the first part 2. The first part 2 includes a protruding part 4, wherein an object can be disposed, and an aperture 5 for hanging the packaging 1 in a display case. The protruding part 4 will substantially have the form of the set of article to be disposed in the packaging. In the figures are the protruding part shaped to receive a communication terminal cover (see FIG. 8). The second part 3 includes a protruding part 6 and connector part 7. The connector part 7 connects the second part 3 to the first part 2, and in a border 8 between the two parts is perforated to enable the second part to be foldable in the relation to the first part. It could also be a fold in the border of thinner material to enable folding in that fold.

Figures 2, 3:
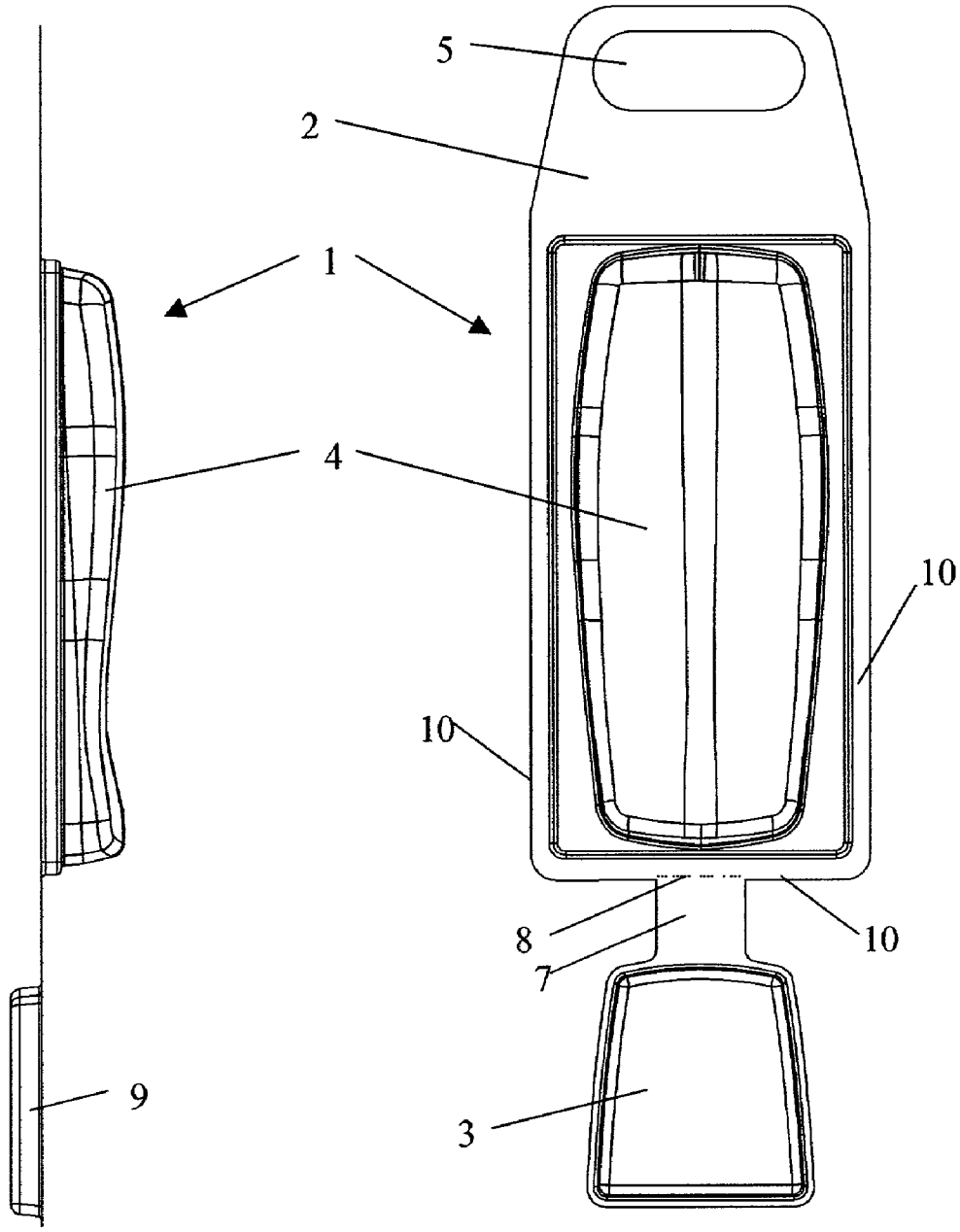
FIG. 2 shows a front view of the packaging.
FIG. 3 shows a first side view of the packaging.
Figure 4:
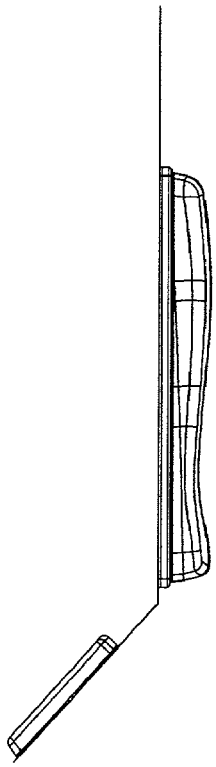
FIGS. 4–7 show different side views of the packaging.
Figure 5:
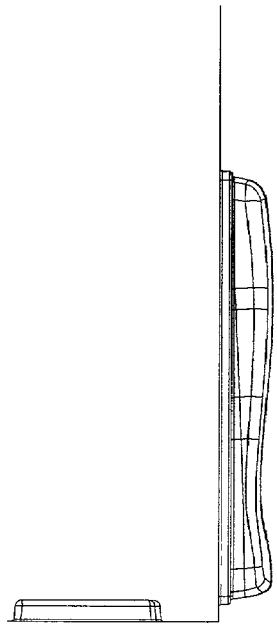
Figure 6:
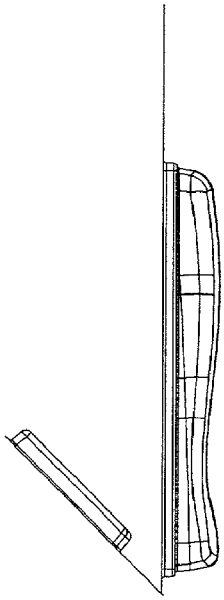

In FIG. 2 are the packaging shown from the front and more clearly indicating the border or fold 8. It also shows the aperture 5 that can have any shape as long as it fits the hanger in the display case or the showcase. The shape could be square, circle, rectangular, ellipse etc. The packaging 1 has been created out of a transparent plastic member by moulding, pressing or any other convenient method for shaping a plastic material.

Figure 7:
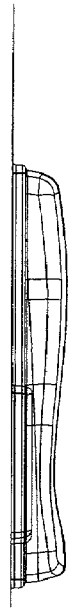

In FIGS. 3–7 is the packaging 1 show from the side having the foldable part 3 folded in different position in relation to the first part 2. There is also shown that the foldable part 3 has also a protruding part 9. In FIG. 7 projects the protruding part 9 into the first part to establish a pressure on the article disposed there and thereby holding the article or articles disposed in the first part in fixed position. A third part (not shown) of the packaging will be applied to cover the foldable part 3 and the article disposed into the first part 2.

Figure 8:
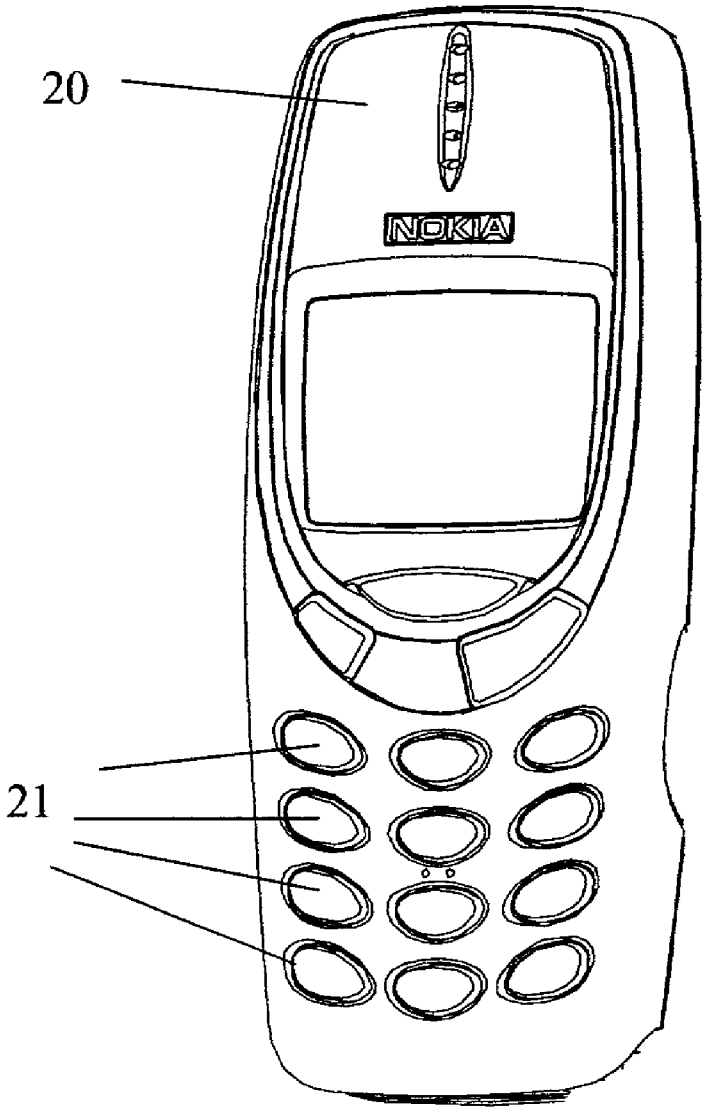
FIG. 8 shows an exchangeable communication terminal cover.

In FIG. 8 is shown an example of an exchangeable communication terminal cover 20 having a keymat 21. In the figure is only the individual keys shown as the mat holding the keys together are located inside the cover 20 and having outer shape that are adapted to the inner shape of the cover 20. These exchangeable communication terminal covers could typically be sold separately from the rest of the communication terminal, but normally provided with a keymat. The reason for selling the keymat with terminal cover is that the keys can be designed more freely so that they do not always have the shape. There will therefore be a specially designed keymat to each terminal cover. In order to ensure that the keymat always is visible as the terminal cover sales packaging is hanging the showcase the packaging is provided with provisions to hold the keymat in relative position to the terminal cover. The means that the keymat is positioned as it would be if the terminal cover had been mounted on the communication terminal and applying the pressure against the rest of the communication to position the keymat in relation to the terminal cover.

The claimed packaging have the foldable part 3 that projects into the protruding part 4, wherein the communication terminal cover and the keymat has been located, and applies a pressure on the keymat so that it remains in position even though the packaging should be shaken or handled roughly. The packaging is finally provided with the third part of the packaging, typically a paper board or the like, that covers the protruding part and the foldable part and hold it together by having surround the outer edges 10 of the first part 2 according to known principles.

The invention is not limited to the above-described examples or to the drawings showing examples of an embodiment, but can be varied within the scope of the appended claims.

What is claimed is:

1. A packaging, the packaging holding an article or a set of articles, the packaging including:

a plastic member with a protruding part, the protruding part allowing for disposal of a first article or a first set of articles being held by the packaging;

a perforation in said plastic member; and a foldable part of said plastic member, said foldable part holding a second article in a fixed position relative to the first article or first set of articles being held by the packaging; and wherein the first article is a cover to a communication terminal and the second article is a keymat to said cover.

2. A packaging according to claim 1, wherein said foldable part includes a second protruding part, said second protruding part holding the second article in the fixed position relative to the first article.

3. A packaging according to claim 1, wherein said foldable part covers the second article, and part of the first article.

4. A packaging according to claim 2, wherein said second protruding part of the foldable part is located in the protruding part of the plastic member, while holding the second article in the fixed position relative to the first article.

5. A method of holding a second article in a position relative to a first article in a packaging for a communication terminal, comprising:

placing said first article in a protruded part of the packaging;

placing said second article in a position relative to the first article; and holding the second article in a fixed position relative to the first article by a foldable part of the packaging, parts of the second article being visible when in the fixed position relative to the first article; and wherein said first article is a cover to a communication terminal and said second article is a keymat to said cover.

6. A method for packing a first article or a first set of articles in a packaging for a communications terminal including:

placing the first article in a protruded part of a packaging;

locating a second article in a position relative to said first article, parts of said second article being visible when located in the position relative to the first article; and folding a foldable part of the packaging to hold said second article in a fixed position relative to said first article; and wherein said first article is a cover to a communication terminal and said second article is a keymat to said cover.

* * * * *